US007098587B2

(12) United States Patent
Hofmann et al.

(10) Patent No.: US 7,098,587 B2
(45) **Date of Patent: *Aug. 29, 2006**

(54) PREVENTING JUNCTION LEAKAGE IN FIELD EMISSION DEVICES

(75) Inventors: James J. Hofmann, Boise, ID (US); John K. Lee, Meridian, ID (US); David A. Cathey, Boise, ID (US); Glen E. Hush, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 215 days.

This patent is subject to a terminal disclaimer.

(21) Appl. No.: 10/400,732

(22) Filed: Mar. 27, 2003

(65) Prior Publication Data

US 2003/0184213 A1 Oct. 2, 2003

Related U.S. Application Data

(60) Division of application No. 10/191,677, filed on Jul. 8, 2002, which is a division of application No. 09/159,245, filed on Sep. 23, 1998, now Pat. No. 6,417,605, which is a continuation-in-part of application No. 08/907,256, filed on Aug. 6, 1997, now abandoned, which is a continuation of application No. 08/542,718, filed on Oct. 13, 1995, now abandoned, which is a continuation-in-part of application No. 08/307,365, filed on Sep. 16, 1994, now abandoned.

(51) Int. Cl.

| | |
|---|---|
| ***H01J 1/62*** | (2006.01) |
| ***H01J 63/04*** | (2006.01) |
| ***H01J 1/02*** | (2006.01) |
| ***H01J 5/50*** | (2006.01) |
| ***G09G 3/10*** | (2006.01) |

(52) U.S. Cl. ..... 313/495; 313/496; 313/497; 313/309; 313/331; 313/355; 315/169.3

(58) Field of Classification Search ..... 313/495, 313/496, 497, 309, 331, 355; 315/169.3
See application file for complete search history.

(56) References Cited

U.S. PATENT DOCUMENTS 3,500,102 A 3/1970 Crost et al.

(Continued)

FOREIGN PATENT DOCUMENTS

| | | |
|---|---|---|
| DE | 2 139 868 | 3/1972 |
| EP | 0 503 638 A2 | 3/1992 |
| EP | 549 133 A1 | 6/1993 |
| GB | 1 311 406 | 3/1973 |

OTHER PUBLICATIONS

Martin J. Berger et al.; "Photon Attenuation Coefficients"; CRC Handbook of Chemistry and Physics; pps. 10–284 and 10–287.

(Continued)

*Primary Examiner*—Karabi Guharay
*Assistant Examiner*—Matt Hodges
(74) *Attorney, Agent, or Firm*—TraskBritt

(57) ABSTRACT

An apparatus and a method for stabilizing the threshold voltage in an active matrix field emission device are disclosed. The method includes the formation of radiation-blocking elements between a cathodoluminescent display screen of the FED and semiconductor junctions formed on a baseplate of the FED.

19 Claims, 5 Drawing Sheets

U.S. PATENT DOCUMENTS

| | | | |
|---|---|---|---|
| 3,814,968 | A | 6/1974 | Nathanson et al. |
| 3,883,760 | A | 5/1975 | Cunningham |
| 3,970,887 | A | 7/1976 | Smith et al. |
| 4,104,532 | A | 8/1978 | Weiss |
| 4,575,765 | A | 3/1986 | Hirt |
| 4,859,304 | A | 8/1989 | Cathey et al. |
| 4,874,981 | A | 10/1989 | Spindt |
| 4,940,916 | A | 7/1990 | Borel et al. |
| 4,992,137 | A | 2/1991 | Cathey et al. |
| 5,000,208 | A | 3/1991 | Ludwig et al. |
| 5,015,912 | A | 5/1991 | Spindt et al. |
| 5,024,722 | A | 6/1991 | Cathey |
| 5,049,520 | A | 9/1991 | Cathey |
| 5,090,932 | A | 2/1992 | Dieumegard et al. |
| 5,100,355 | A | 3/1992 | Marcus et al. |
| 5,141,461 | A | 8/1992 | Nishimura et al. |
| 5,142,184 | A | 8/1992 | Kane |
| 5,151,061 | A | 9/1992 | Sandhu |
| 5,162,704 | A | 11/1992 | Kobori et al. |
| 5,186,670 | A | 2/1993 | Doan et al. |
| 5,191,217 | A | 3/1993 | Kane et al. |
| 5,199,917 | A | 4/1993 | MacDonald et al. |
| 5,204,581 | A | 4/1993 | Andreadakis et al. |
| 5,205,770 | A | 4/1993 | Lowrey et al. |
| 5,210,472 | A | 5/1993 | Casper et al. |
| 5,212,426 | A | 5/1993 | Kane |
| 5,219,310 | A | 6/1993 | Tomo et al. |
| 5,229,331 | A | 7/1993 | Doan et al. |
| 5,229,682 | A | 7/1993 | Komatsu |
| 5,232,549 | A | 8/1993 | Cathey et al. |
| 5,259,799 | A | 11/1993 | Doan et al. |
| 5,283,500 | A | 2/1994 | Kochanski |
| 5,329,207 | A | 7/1994 | Cathey et al. |
| 5,342,477 | A | 8/1994 | Cathey |
| 5,358,599 | A | 10/1994 | Cathey et al. |
| 5,358,601 | A | 10/1994 | Cathey |
| 5,358,908 | A | 10/1994 | Reinberg et al. |
| 5,372,973 | A | 12/1994 | Doan et al. |
| 5,374,868 | A | 12/1994 | Tjaden et al. |
| 5,391,259 | A | 2/1995 | Cathey et al. |
| 5,394,006 | A | 2/1995 | Liu |
| 5,448,133 | A | 9/1995 | Ise |
| 5,451,830 | A | 9/1995 | Huang |
| 5,483,118 | A | 1/1996 | Nakamoto et al. |
| 5,500,750 | A | 3/1996 | Kanbe et al. |
| 5,600,698 | A | 2/1997 | Terashima et al. |
| 5,620,832 | A | 4/1997 | Sung et al. |
| 5,621,272 | A | 4/1997 | Levine et al. |
| 5,632,664 | A | 5/1997 | Scoggan et al. |
| 5,633,560 | A | 5/1997 | Huang |
| 5,637,023 | A | 6/1997 | Itoh et al. |
| 5,643,033 | A | 7/1997 | Gnade et al. |
| 5,643,817 | A | 7/1997 | Kim et al. |
| 5,648,698 | A | 7/1997 | Makishima et al. |
| 5,648,699 | A | 7/1997 | Jin et al. |
| 5,865,657 | A | 2/1999 | Haven et al. |
| 5,866,281 | A | 2/1999 | Guckel et al. |
| 5,866,979 | A | 2/1999 | Cathey, Jr. et al. |
| 5,889,758 | A | 3/1999 | Maehara et al. |
| 5,970,114 | A | 10/1999 | Lee et al. |
| 5,975,975 | A | 11/1999 | Hofmann et al. |
| 6,020,683 | A | 2/2000 | Cathey, Jr. et al. |
| 6,040,613 | A | 3/2000 | McTeer et al. |
| 6,186,850 | B1 | 2/2001 | Cathey, Jr. et al. |
| 6,398,608 | B1 | 6/2002 | Cathey, Jr. et al. |
| 6,417,605 | B1 | 7/2002 | Hofmann et al. |

OTHER PUBLICATIONS

S.M. Sze; "Phonon Spectra and Optical, Thermal, and High–Field Properties of Semiconductors"; Physics of Semiconductor Devices; pps. 38–43.

R. Meyer; "6" Diagonal Microtips Fluorescent Display for T.V. Applications"; pps. 374–377.

H.B. Garg et al., "Soft X–Ray Absorption in the Bulk", X–Ray Absorption in Bulk and Surfaces, Aug. 18–20, 1992, pps. 123–141.

"Physics of Semiconductor Devices," S.M. Sze., Bell Laboratories, Inc. 1981.

"Vacuum Microelectronics," Heinz H. Busta, Journal of Micronmechanics and Microengineering, 1992.

*Micron Display Technology, Inc., Overview*, Micron Technology, Inc., Rev. 2: Oct. 26, 1992.

"The Flat Panel Display Market," Electronic Trend Publications, 1991.

The Cathode–Ray Tube, Technology, History, and Applications, Peter A. Keller, 1991.

Elements of Physics, A. Smith et al., McGraw–Hill, pp. 618–620.

The Photonics Dictionary™, p. D–125.

PREVENTING JUNCTION LEAKAGE IN FIELD EMISSION DEVICES

CROSS-REFERENCE TO RELATED APPLICATIONS

This application is a divisional of application Ser. No. 10/191,677, filed Jul. 8, 2002, now U.S. Pat. No. 6,712,664, issued Mar. 30, 2004, which is a divisional of application Ser. No. 09/159,245, filed Sep. 23, 1998, now U.S. Pat. No. 6,417,605 B1, issued Jul. 9, 2002, which is a continuation-in-part of application Ser. No. 08/907,256, filed Aug. 6, 1997, now abandoned, which is a continuation of Ser. No. 08/542,718, filed Oct. 13, 1995, now abandoned, which is a continuation-in-part of Ser. No. 08/307,365, filed Sep. 16, 1994, now abandoned.

GOVERNMENT LICENSE RIGHTS

This invention was made with Government support under Contract No. DABT63-93-C-0025 awarded to Advanced Research Projects Agency (ARPA). The Government has certain rights in this invention.

BACKGROUND OF THE INVENTION

1. Field of the Invention

This invention relates generally to stabilizing the threshold voltage active elements in active matrix Field Emission Displays (FEDs).

2. State of the Art

A cold cathode FED uses electron emissions to illuminate a cathodoluminescent screen and generate a visual image. An individual field emission cell typically includes one or more emitter sites formed on a baseplate. The baseplate in active matrix FEDs typically contains the active semiconductor devices (e.g., field effect transistors) that control electron emissions from the emitter sites. The emitter sites may be formed directly on a baseplate formed of a material such as silicon or on an interlevel conductive layer (e.g., polysilicon) or interlevel insulating layer (e.g., silicon dioxide, silicon nitride) formed on the baseplate. A gate electrode structure, or grid, is typically associated with the emitter sites. The emitter sites and grids are connected to an electrical source for establishing a voltage differential to cause a Fowler-Nordheim electron emission from the emitter sites. These electrons strike a display screen having a phosphor coating, releasing the photons that illuminate the screen. A single pixel of the display screen is typically illuminated by one or more emitter sites.

In a gated FED, the grid is separated from the base by an insulating layer. This insulating layer provides support for the grid and prevents the breakdown of the voltage differential between the grid and the baseplate. Individual field emission cells are sometimes referred to as vacuum microelectronic triodes. The triode elements include the cathode (field emitter site), the anode (cathodoluminescent element) and the gate (grid). U.S. Pat. No. 5,210,472, granted to Stephen L. Casper and Tyler A. Lowrey, entitled "Flat Panel Display In Which Low-Voltage Row and Column Address Signals Control A Much Higher Pixel Activation Voltage," and incorporated herein by reference, describes a flat panel display that utilizes FEDs.

The quality and sharpness of an illuminated pixel site of the display screen is dependent upon the precise control of the electron emission from the emitter sites that illuminate a particular pixel site. In forming a visual image, such as a number or letter, different groups of emitter sites must be cycled on or off to illuminate the appropriate pixel sites on the display screen. To form a desired image, electron emissions may be initiated in the emitter sites for certain pixel sites while the adjacent pixel sites are held in an off condition. For a sharp image, it is important that those pixel sites required to be isolated remain in an off condition. Thus, shifts in the threshold voltage ($V_T$) (the voltage necessary to turn on the transistor for the pixel) are undesirable, and there is difficulty in maintaining the $V_T$ at a level such that unwanted activation will not occur.

BRIEF SUMMARY OF THE INVENTION

It is an object of the present invention to provide an improved method of constructing an FED with a light-blocking element that prevents photons generated in the environment and by a display screen of the FED from affecting semiconductor junctions on a baseplate of the FED. It is a still further object of the present invention to provide an improved method of constructing FEDs using an opaque layer that protects semiconductor junctions on a baseplate from light and which may also perform other circuit functions. It is a still further object of the present invention to provide an FED with improved junction leakage characteristics using techniques that are compatible with large-scale semiconductor manufacture. A further object of this invention is to provide a means for protecting the cathode structure of an FED. A still further object of the present invention is to shield transistors and semiconductor junctions of an FED against X-rays and other electromagnetic radiation. Finally, it is still further an object of the present invention to manufacture a high-quality FED display having a long life.

In accordance with the present invention, an improved method of constructing FEDs for flat panel displays and other electronic equipment is provided. The method, generally stated, comprises the formation of radiation-blocking elements between a cathodoluminescent display screen and baseplate of the FED. A light-blocking element protects semiconductor junctions on a substrate of the FED from photons generated in the environment and by the display screen. An X-ray-blocking element prevents damage to the cathode structures from X-rays generated when electrons bombard the phosphor screen. The light-blocking element may be formed as an opaque layer adapted to absorb or reflect light. In addition to protecting the semiconductor junctions from the effects of photons, the opaque layer may serve other circuit functions. The opaque layer, for example, may be patterned to form interlevel connecting lines for circuit components of the FED.

In an illustrative embodiment, the light-blocking element is formed as an opaque, light-absorbing material deposited on a baseplate for the FED. As an example, a metal such as titanium that tends to absorb light can be deposited on the baseplate of an FED. Other suitable opaque materials include insulative light-absorbing materials such as carbon black, impregnated polyamide, manganese oxide and manganese dioxide. Moreover, such a light-absorbing layer may be patterned to cover only the areas of the baseplate that contain semiconductor junctions. The light-blocking element may also be formed of a layer of a material, such as aluminum, adapted to reflect rather than absorb light.

In another embodiment, an X-ray-blocking layer is formed, the layer comprising an X-ray-blocking material disposed between the picture elements and the cathodes. As an example, a metal such as tungsten that has a high atomic number Z and tends to block X-rays, may be used in order to prevent, at least partially, X-ray radiation from damaging the cathode structures. Lead, titanium, and other metals, ceramics and compounds that have a high atomic number Z and tend to block X-rays may serve as suitable alternative materials. The X-ray-blocking layer can also be patterned to cover only particular areas that house sensitive cathode structures and semiconductor junctions, and may be formed of layers of more than one type of X-ray-blocking material.

Other objects, advantages and capabilities of the present invention will become more apparent as the description proceeds.

DETAILED DESCRIPTION OF THE INVENTION

Figure 1:
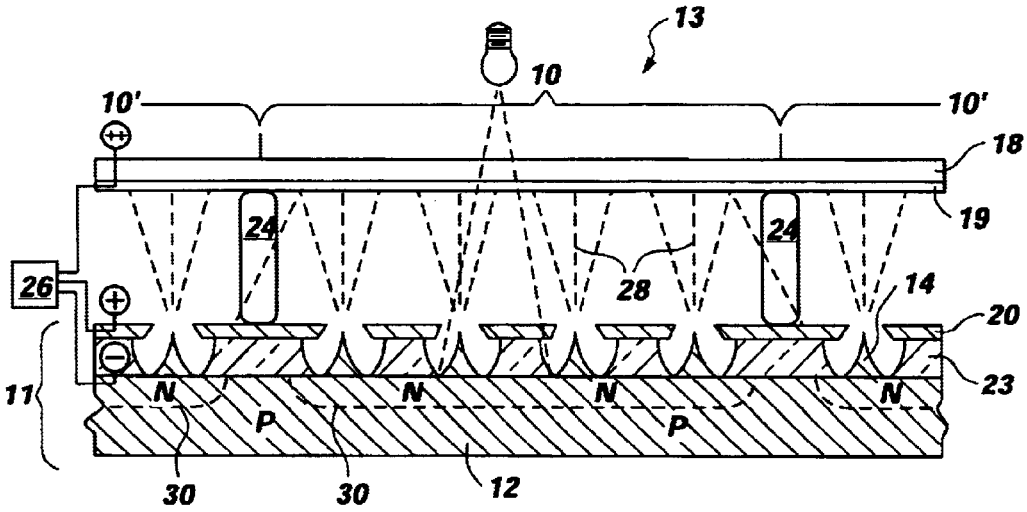
Fig. 1 (PRIOR ART)
FIG. 1 is a cross-sectional schematic view of a prior art FED showing a pixel site and portions of adjacent pixel sites.

It has been found that photons generated by the luminescent display screen, as well as photons present in the environment (e.g., sunshine), cause an emitter site to emit electrons unexpectedly. In some FEDs, P/N junctions can be used to electrically isolate each pixel site and to construct row-column drive circuitry and current regulation circuitry for the pixel operation. During operation of the FED, some of the photons generated at a display screen, as well as photons from the environment, may strike the semiconductor junctions on the substrate. This may affect the junctions by changing their electrical characteristics. In some cases, this may cause an unwanted current to pass across the junction. This is one type of junction leakage in an FED that may adversely affect the address or activation of pixel sites and cause stray emissions and consequently a degraded image quality.

In experiments conducted by the inventors, junction leakage currents have been measured in the laboratory as a function of different lighting conditions at the junction. At a voltage of about 50 volts, and depending on the intensity of light directed at a junction, junction leakage may range from picoamps (i.e., $10^{-12}$ amps) for dark conditions, to microamps (i.e., $10^{-6}$ amps) for well-lit conditions. In FEDs, even relatively small leakage currents (i.e. picoamps) will adversely affect the image quality. The treatise entitled "Physics of Semiconducting Devices" by S. M. Sze, copyright 1981 by John Wiley and Sons, Inc., at paragraphs 1.6.1 to 1.6.3, briefly describes the effect of photon energy on semiconductor junctions.

Moreover, it has been found by the inventors that unblocked electromagnetic radiation may damage the semiconductor junctions or the cathode structure. Exposure to photons from the display screen and external environment may change the properties of some junctions on the substrate associated with the emitter sites, causing current flow and the initiation of electron emissions from the emitter sites on the adjacent pixel sites. The electron emissions may cause the adjacent pixel sites to illuminate when a dark background is desired, again causing a degraded or blurry image. In addition to isolation and activation problems, light from the environment and display screen striking junctions on the substrate may cause other problems in addressing and regulating current flow to the emitter sites of the FED cell.

For example, a problem may occur when photons (i.e., light) generated by a light source strike the semiconductor junctions formed in the substrate. Further, photons from an illuminated pixel site may strike the junctions formed at the N-type conductivity regions on the adjacent pixel sites. The photons are capable of passing through the spacers, grid and insulating layer of the FED, because these layers are often formed of materials that are translucent to most wavelengths of light, such as spacers formed of a translucent polyamide (e.g., kapton or silicon nitride), or an insulative layer may be formed of translucent silicon dioxide, silicon nitride or silicon oxynitride. The grid may also be formed of translucent polysilicon.

U.S. Pat. No. 3,814,968, granted to Nathanson et al., addresses the problem with aluminization deposited on the screen member. However, such an approach does not work for high resolution active matrix FEDs, because cathode voltages are relatively low (e.g., 200 volts), and an aluminum layer formed on the inside surface of the display screen cannot be penetrated by enough electrons emitted at these low voltages. Therefore, this approach is not suitable in an active matrix FED.

It is also known in the art to construct FEDs with circuit traces formed of an opaque material, such as chromium, that overlie the semiconductor junctions contained in the FED baseplate. As an example, U.S. Pat. No. 3,970,887, granted to Smith et al., describes such a structure (see FIG. 8). However, these circuit traces are constructed to conduct signals, and are not specifically adapted for isolating the semiconductor junctions from photon bombardment. Accordingly, most of the junction areas are left exposed to photon emission and the resultant junction leakage.

Another problem which may arise is caused by the presence of X-rays or radiation, often generated when electrons impinge upon the phosphor screen. The term "X-ray" means an electromagnetic radiation which has wavelengths in the range of 0.06 nm to 12.5 nm; visible light has wavelengths in the range of 400 nm to 800 nm. In FEDs, generated X-rays are emitted in virtually all directions. Because of the close proximity of the cathode to the X-ray emitting anode in an FED, it has been found that the cathode structure may be damaged by such exposure. In particular, if a silicon chip is used as a substrate on which the cathode structure is built up, the transistors or semiconductor junctions on the baseplate are susceptible to damage from these X-rays.

Referring now to drawing FIG. 1, an example embodiment is shown with a pixel site 10 of a field emission display (FED) 13 and portions of adjacent pixel sites 10' on either side. The FED 13 includes a baseplate 11 having a substrate 12 comprising, for example, single crystal P-type silicon. A plurality of emitter sites 14 is formed on an N-type conductivity region 30 of the substrate 12. The P-type substrate 12 and N-type conductivity region 30 form a P/N junction. This type of junction can be combined with other circuit elements to form electrical devices, such as FEDs, for activating and regulating current flow to the pixel sites 10 and 10'.

The emitter sites 14 are adapted to emit electrons 28 that are directed at a cathodoluminescent display screen 18 coated with a phosphor material 19. A gate electrode or grid 20, separated from the substrate 12 by an insulating layer 23, surrounds each emitter site 14. Support structures 24, also referred to as spacers, are located between the baseplate 11 and the display screen 18.

An electrical source 26 establishes a voltage differential between the emitter sites 14 and the grid 20 and display screen 18. The electrons 28 from activated emitter sites 14 generate the emission of photons from the phosphor material contained in the corresponding pixel site 10 of the display screen 18. To form a particular image, it may be necessary to illuminate pixel site 10 while adjacent pixel sites 10' on either side remain dark.

Figure 2:
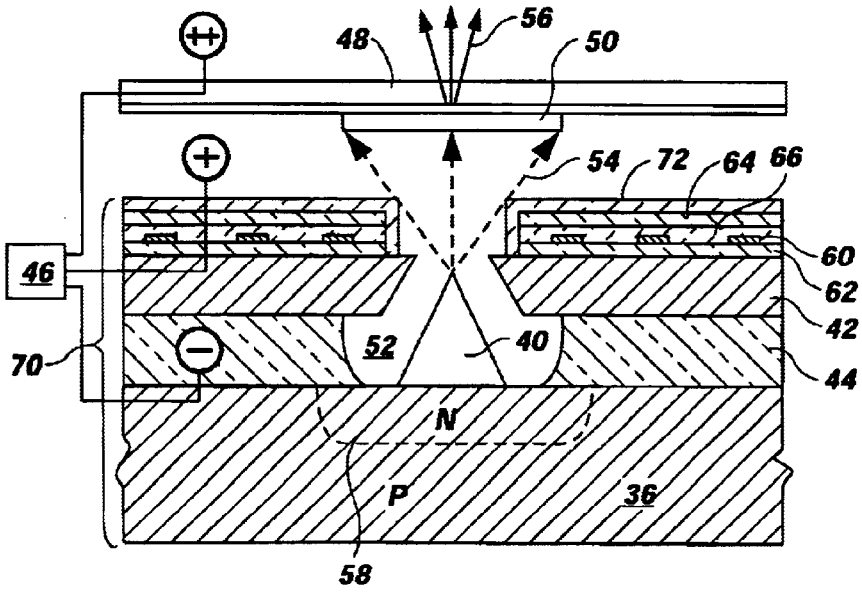
FIG. 2 is a cross-sectional schematic view of an emitter site for an FED having a light-blocking element formed in accordance with the invention.

Referring now to drawing FIG. 2, an emitter site 40 of an FED is illustrated schematically. The emitter site 40 can be formed with one or more sharpened tips as shown or with one or more sharpened cones, apexes or knife edges. The emitter site 40 is formed on a substrate 36. In the illustrative embodiment, the substrate 36 is single crystal P-type silicon. Alternately, the emitter site 40 may be formed on another substrate material or on an intermediate layer formed of a glass layer or an insulator-glass composite. In the illustrative embodiment, the emitter site 40 is formed on an N-type conductivity region 58 of the substrate 36. The N-type conductivity region may be part of a source or drain of an FED transistor that controls the emitter site 40. The N-type conductivity region 58 and P-type substrate 36 form a semiconductor P/N junction.

Surrounding the emitter site 40 is a gate structure or grid 42. The grid 42 is separated from the substrate 36 by an insulating layer 44. The insulating layer 44 includes an etched opening 52 for the emitter site 40. The grid 42 is connected to conductive lines 60 formed on an interlevel insulating layer 62. The conductive lines 60 are embedded in an insulating layer and/or passivation layer 66 and are used to control operation of the grid 42 or other circuit components.

A display screen 48 is aligned with the emitter site 40 and includes a phosphor coating 50 in the path of electrons 54 emitted by the emitter site 40. An electrical source 46 is connected directly or indirectly to the emitter site 40 which functions as a cathode. The electrical source 46 is also connected to the grid 42 and to the display screen 48 which function as an anode.

When a voltage differential is generated by the electrical source 46 between the emitter site 40, the grid 42 and the display screen 48, electrons 54 are emitted at the emitter site 40. These electrons 54 strike the phosphor coating 50 on the display screen 48. This produces the photons 56 that illuminate the display screen 48.

For all of the circuit elements described thus far, fabrication processes that are known in the art can be utilized. As an example, U.S. Pat. No. 5,186,670, granted to Doan et al. and incorporated herein by reference, describes suitable processes for forming the substrate 36, emitter site 40 and grid 42.

The substrate 36 and grid 42 and their associated circuitry form the baseplate 70 of the FED. The silicon substrate contains semiconductor devices that control the operation of the emitter site 40. These devices are combined to form row-column drive circuitry, current regulation circuitry, and circuitry for electrically activating or isolating the emitter site 40. As an example, the previously cited U.S. Pat. No. 5,210,472, granted to Casper et al. and incorporated herein by reference, describes pairs of MOSFETs formed on a silicon substrate and connected in series to emitter sites. One of the series connected MOSFETs is gated by a signal on the row line. The other MOSFET is gated by a signal on the column line.

In accordance with one embodiment of the present invention, a light-blocking layer 64 is formed on the baseplate 70. The light-blocking layer 64 prevents light from the environment and light generated at the display screen 48 from striking semiconductor junctions, such as the junction formed by the N-type conductivity region 58, on the substrate 36. A passivation layer 72 is formed over the light-blocking layer 64.

The light-blocking layer 64 is formed of a material that is opaque to light. Further, light-blocking layer 64 is, in the alternative, a conductive or an insulative material. In addition, the light-blocking layer 64 is, also in the alternative, either light absorptive or light reflective. Suitable materials include both absorptive materials and reflective materials (for example, titanium or aluminum). Other suitable conductive materials include: aluminum-copper alloys, refractory metals, and refractory metal silicides. In addition, suitable insulative materials include manganese oxide, manganese dioxide or a chemical polymer (for example, carbon black impregnated polyamide). These insulative materials tend to absorb light and can be deposited in a relatively thick layer.

For a light-blocking layer 64 formed of metal, acceptable deposition techniques include: CVD, sputtering, or electron beam deposition (EBD). For a light-blocking layer 64 formed of an insulative material or chemical polymer, acceptable techniques include liquid deposition, and cure processes are used according to some embodiments to form a layer having a desired thickness.

The light-blocking layer 64 is blanket deposited in some embodiments to cover substantially all of the baseplate 70. Alternatively, light-blocking layer 64 is patterned using a photolithography process, thus protecting predetermined areas on the substrate 36 (i.e., areas occupied by junctions). Furthermore, according to still further embodiments, light-blocking layer 64 is constructed to serve other circuit functions. As an example, in one embodiment, light-blocking layer 64 is patterned to function as an interlevel connector.

An acceptable process sequence for forming an emitter site 40 with the light-blocking layer 64 is as follows:

1. Form electron emitter sites 40 as protuberances, tips, wedges, cones or knife edges by masking and etching the silicon substrate 36.

2. Form N-type conductivity regions 58 for the emitter sites 40 by patterning and doping a single crystal silicon substrate 36.

3. Oxidation sharpen the emitter sites 40 using a suitable oxidation process.

4. Form the insulating layer 44 by the conformal deposition of a layer of silicon dioxide. Other insulating materials such as silicon nitride and silicon oxynitride may also be used.

5. Form the grid 42 by deposition of doped polysilicon followed by chemical mechanical planarization (CMP) for self aligning the grid 42 and emitter site 40. Such a process is detailed in the U.S. Pat. No. 5,229,331 to Rolfson et al., incorporated herein by reference. In place of polysilicon, other conductive materials such as chromium, molybdenum and other metals may also be used.

6. Photopattern and dry etch the grid 42.

7. Form interlevel insulating layer 62 on grid 42. Form contacts through the insulating layer 62 by photopatterning and etching.

8. Form metal conductive lines 60 for grid connections and other circuitry. Form passivation layer 66.

9. Form the light-blocking layer 64. According to some embodiments, for example, for a light-blocking layer formed of titanium or other metal, the light-blocking layer is deposited to a thickness of between about 2000 Å and about 4000 Å. Other materials are deposited to a thickness suitable for that particular material.

10. Photopattern and dry etch the light-blocking layer 64, passivation layer 66 and insulating layer 62 to open emitter and bond pad connection areas.

11. Form passivation layer 72 on light-blocking layer 64.

12. Form openings through the passivation layer 72 for the emitter sites 40.

13. Etch the insulating layer 44 to open the etched opening 52 for the emitter sites 40. This is accomplished according to one embodiment using photopatterning and wet etching. For silicon emitter sites 40 oxidation sharpened with a layer of silicon dioxide, one suitable wet etchant is diluted HF acid.

14. Continue processing to form spacers and display screen.

Thus the invention provides a method for preventing junction leakage in an FED utilizing a light-blocking element formed on the baseplate of the FED. It is understood that the above process sequence is merely exemplary and may be varied, depending upon differences in the baseplate, emitter site and grid materials and their associated formation technology.

It has also been found that, in addition to visible light, X-rays are emitted by the phosphor, which also contribute to an unstable threshold voltage $V_T$. Therefore, referring now to drawing FIG. 3, an embodiment of the invention is seen in which an X-ray blocker 110 is disposed between the faceplate 112 and the baseplate 14' of an FED 16. More particularly, in this embodiment, the blocker 110 is disposed adjacent to a grid structure or gate 15 with an aperture 10*a* allowing electrons to pass therethrough. X-rays from faceplate 112 are then blocked from transistor gate 15.

Figure 3:
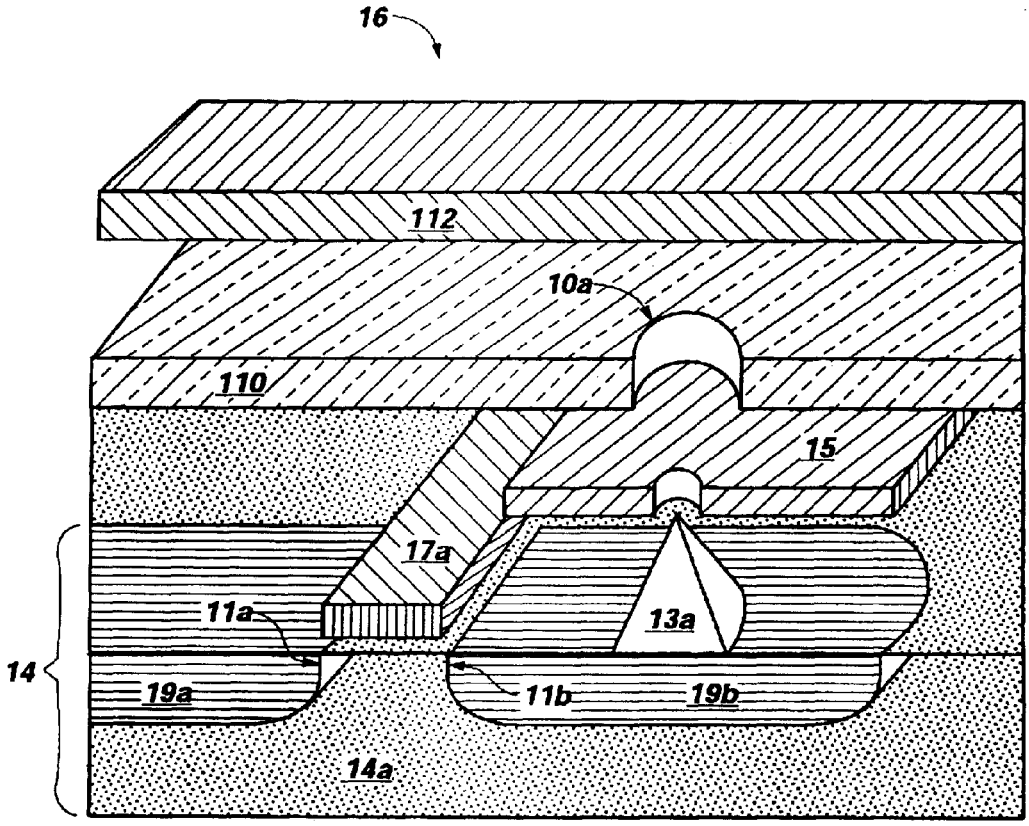
FIG. 3 is a perspective view of a cathode structure for an FED having an X-ray-blocking element formed in accordance with the invention.

Referring still to FIG. 3, a cathode structure of an example embodiment of the present invention is shown at baseplate 14', wherein a silicon wafer provides a P-substrate 14*a*. Two P/N junctions 11*a* and 11*b* are formed by doping two N+ transistors 19*a* and 19*b* into the P-substrate 14*a*. A further conductive layer 17*a* overlays the P/N junctions, so a transistor 19*a*/19*b* is formed on the substrate. The transistor 19*a*/19*b* belongs to an active matrix stack useful for controlling so-called cold cathode emission sites. One of the cold cathode emission sites is depicted in drawing FIG. 3, comprising an emitter 13*a* formed on N+ transistor 19*b*. The emitter 13*a* is surrounded by a grid structure or gate 15. The various conducting layers are separated by insulating layers (not shown in FIG. 3). The cathode is connected to a negative potential, whereas the extraction grid is connected to a positive potential, as is known to those skilled in this art.

Most materials useful for blocking X-rays have a mass attenuation coefficient which varies as a function of X-ray energy. Also, while two materials may be useful for blocking X-rays, one may absorb more X-rays of lower energy (higher wavelength) while the other material may absorb more for higher energy (lower wavelength) X-rays. Therefore, in some embodiments, multiple X-ray-blocking materials are used to facilitate absorption of X-rays over a broader range of energy levels than could be accomplished with each material individually.

Acceptable X-ray-blocking materials for the present invention extend to any chemical elements or compounds having a high atomic number Z. Tungsten and lead are examples of such materials. Titanium is also a good material for blocking X-rays. Blocking materials, in particular, materials having high atomic numbers Z, are provided according to various embodiments of the invention in the form of metals, oxides, ceramics, etc.

Materials employed for light-blocking are not necessarily good for X-ray blocking. Such limitations in selecting protective materials are overcome, according to the invention, in stacking more than one layer of protective materials, one on top of the other. A further approach contemplated by the present invention is to apply several blocking materials simultaneously, each blocking different wavelengths of the electromagnetic spectrum (although some overlap is permissible).

As discussed above, in some embodiments, two X-ray-blocking layers are employed. In one such embodiment, the bottom layer blocks the main portion of X-rays produced by the anodes, whereas the top layer of the stack is selected to aid in light-blocking as well as filling the X-ray band gaps in the bottom material. Tungsten as a bottom layer with aluminum as the top layer is one example. However, any other combination or coordination of the location and the blocking ability of a layer is also contemplated by the present invention.

Referring again to the drawing FIG. 3 embodiment, an aperture 10*a* is shown at the sites of the cold cathode emitters. However, in embodiments using X-ray-blocking materials that are permeable for electron beams, no aperture is used.

Figure 4A:
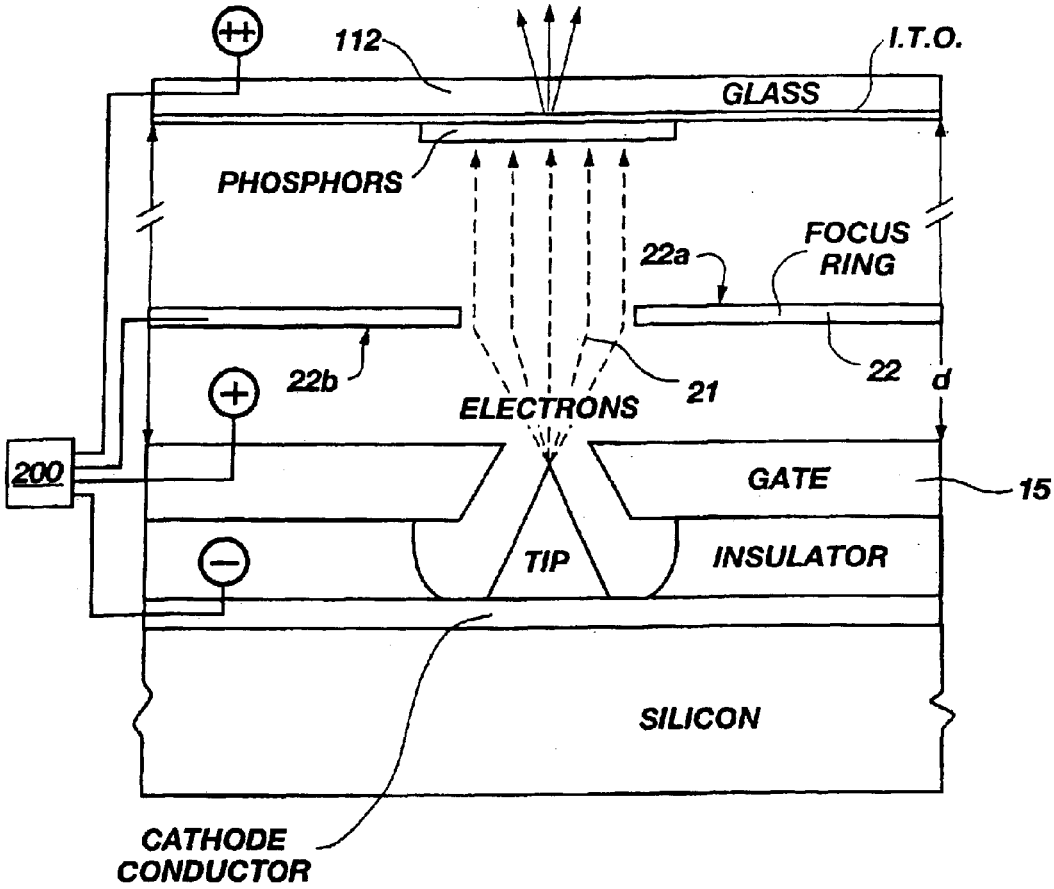
Fig. 4A (PRIOR ART)
FIGS. 4A and 4B are elevational views of a pixel/emission site of an FED.
Figure 4B:
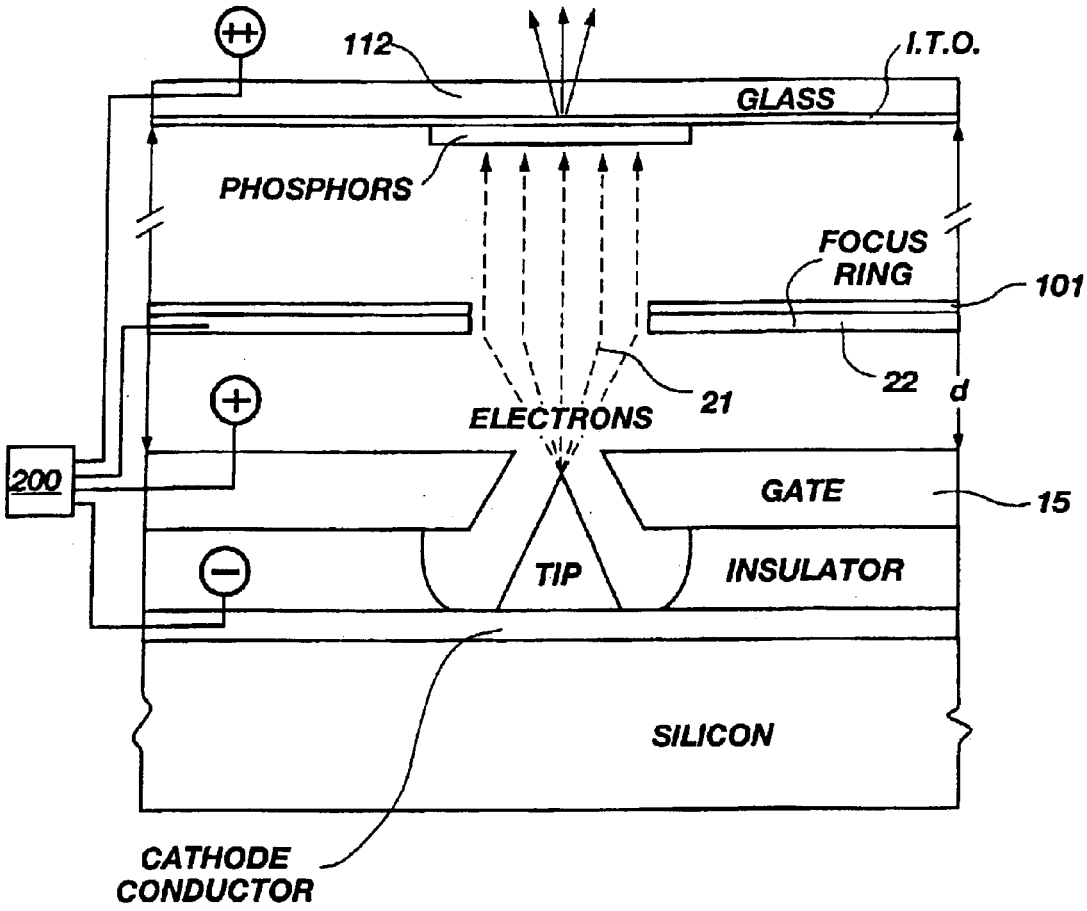

Drawing FIG. 4A shows a structure similar to the structure shown in drawing FIG. 2 of U.S. Pat. No. 5,186,670, and this patent has been assigned to the assignee of the present invention and is hereby incorporated by reference. The basic structure of this FED has been described in conjunction with drawing FIG. 3. FIG. 4A also includes a power supply 200. In addition, a focus ring 22 is established at a distance from the gate 15. The function of the focus ring 22 is to focus the electron beam 21 onto the faceplate 112. According to a further embodiment of the present invention, focus ring 22 is made impermeable to X-rays by application of an X-ray-blocking material on, alternatively, the top side 22*a* of focus ring 22 or the bottom side 22*b* of the focus ring 22, or both. In some embodiments, the X-ray-blocking material comprises a conductor and functions also as the focus ring 22. Drawing FIG. 4B depicts a modification of Drawing FIG. 4A, wherein an X-ray protection layer 101 is disposed on top of focus ring 22.

Figure 5:
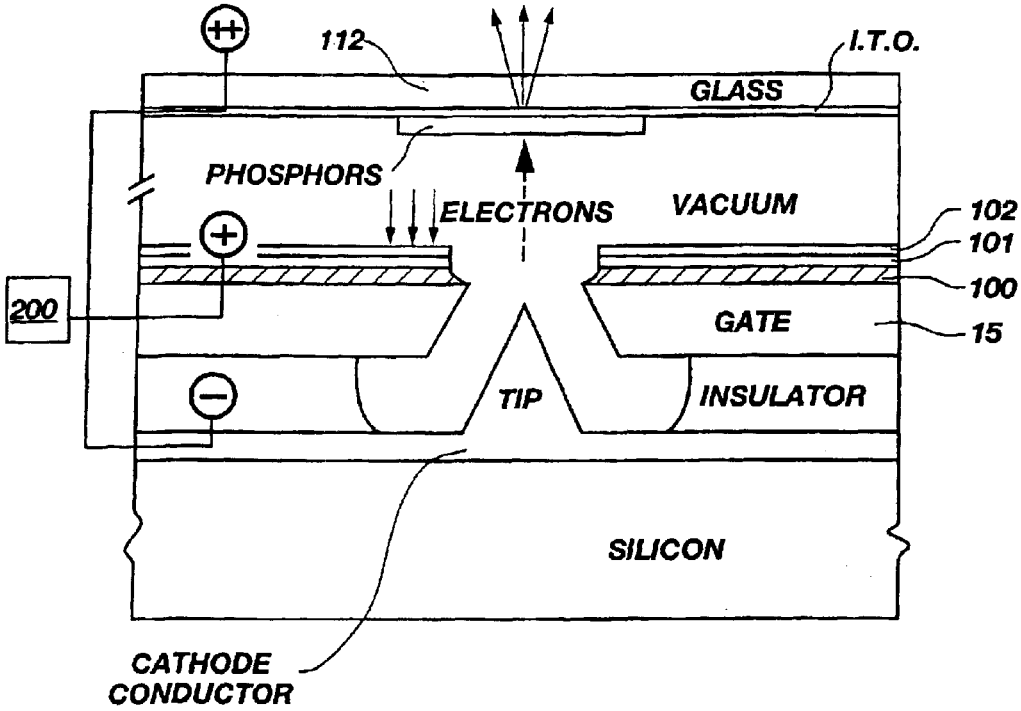
FIG. 5 is another elevational view of a pixel/emission site of an FED according to the present invention.

Referring now to drawing FIG. 5, a further embodiment of the present invention is shown in which an insulating layer 100, X-ray protection layer 101 and blocking layer 102 is disposed between the faceplate 112 and the cathode structure. Layers 101 and 102 are placed adjacent to the gate 15, separated by an insulating layer 100. More particularly, the insulating layer 100 and one or more of the layers 101 and 102 are deposited on the stack of the silicon substrate by methods known to those skilled in this art.

Examples of blocking material for X-ray blocker 110 of drawing FIG. 3 or layers 101 and 102 comprise: tungsten, lead, titanium.

The layers 101, 102 are also selected according to other requirements necessary for the functioning of the vacuum device according to drawing FIG. 5. For example, the following materials and combinations may be applied to gate 15 of drawing FIG. 5 by vapor deposition or direct sputter and etched in the same process as the etching of the cathode in the forming of a self-aligned gate structure (as described in U.S. Pat. No. 5,372,973, incorporated herein by reference): tungsten, lead, titanium.

The thickness of the blocker 110 or layers 101, 102 may be determined using the following equation:

$$I_{(X)}/I_0=e^{-\mu\rho x}$$

Restated, radiation traversing a layer of substance is reduced in intensity by a constant fraction μ per centimeter. After penetrating to a depth x, the intensity is:

$$I_{(X)}=I_0e^{-\mu\rho x}$$

In the above equations, $I_o$ is the initial intensity, $I_{(x)}$ is the intensity after path length x, ρ is the mass density of the element in question, and μ is the mass attenuation coefficient describing the attenuation of radiation as it passes through matter by the above equation. The term μ/ρ is the mass absorption coefficient where ρ is the density of the material. The mass attenuation coefficients to be used are for photons for elements at energies corresponding to the wavelengths of the X-rays (radiation) to be blocked by the blocker 110 or layers 101, 102 should be used. Since X-rays of differing wavelengths are to be blocked, the calculation is required for the desired energy levels of X-rays to be blocked by the desired material to be used. Further, since thin films of blocking materials are used, mass attenuation coefficients for materials applied in thin films should be used.

According to another aspect of the present invention, a process for making a field emission device is also provided comprising: forming an emitter on a substrate; forming a dielectric layer over the emitter; forming an X-ray-(radiation-) blocking layer over the dielectric layer; and positioning, in a vacuum, the emitter in opposed relation to a phosphor screen. Examples of acceptable methods for forming the emitter on the substrate are seen in U.S. Pat. Nos. 5,391,259; 5,374,868; 5,358,908; 5,358,601; 5,358,599; 5,329,207; 5,372,973; 4,859,304; and 4,992,137; all of which are incorporated herein by reference.

According to a further embodiment, the forming of an X-ray-blocking layer comprises forming a conductive layer of X-ray material as a grid over the emitter. According to an alternative embodiment, the process further includes the steps of: forming a grid over the dielectric layer and forming an insulator over the grid, wherein forming an X-ray-blocking layer comprises forming an X-ray-blocking layer over the insulator. According to a still further embodiment, forming an X-ray-blocking layer further comprises forming a conductive X-ray-blocking layer over the insulator.

According to a still further embodiment, a focus ring is formed over the emitter and forming an X-ray-blocking layer comprises forming an X-ray-blocking layer on a surface of the focus ring between the focus ring and the emitter. According to an alternative embodiment, forming an X-ray-blocking layer comprises forming an X-ray-blocking layer on a surface of the focus ring between the focus ring and the phosphor screen.

According to a still further embodiment of the invention, the light-blocking layer is tied to a fixed potential in relation to the anode or cathode. This fixing of the potential avoids charge build-up on the blocking layer, which would degrade performance of the device.

All of the United States patents cited herein are hereby incorporated by reference as if set forth in their entirety.

While the particular process as herein shown and disclosed in detail is fully capable of obtaining the object and advantages hereinbefore stated, it is to be understood that it is merely illustrative of the example embodiments of the invention and that no limitations are intended to the details of construction or design herein shown other than as mentioned in the appended claims.

What is claimed is:

1. A field emission device comprising:

an anode;

a cathode comprising a plurality of emitters and a plurality of transistors, each of the plurality of transistors being associated with a set of one or more of the plurality of emitters, each of the plurality of transistors being operable to selectively permit any emitter connected thereto to emit electrons for traveling towards the anode and to selectively substantially prevent any emitter connected thereto from emitting electrons; and a layer including an X-ray-absorbing material, the layer being disposed between the anode and the cathode, the layer for substantially shielding at least one transistor of the plurality of transistors from radiation emitted from the anode.

2. The device as in claim 1, wherein the layer including X-ray-absorbing material comprises a material chosen from a group consisting of tungsten, lead, and titanium.

3. The device as in claim 1, wherein the layer including X-ray-absorbing material comprises two layers of X-ray-absorbing material having different gaps in an X-ray-absorbing bandwidth.

4. The device as in claim 3, wherein a first of the two layers of X-ray-absorbing material comprises one of tungsten and titanium.

5. The device as in claim 3, wherein a second of the two layers of X-ray-absorbing material comprises titanium.

6. The device according to claim 1, wherein each transistor of the plurality of transistors and at least one emitter of the set of one or more of the plurality of emitters comprises the cathode of the device.

7. The device as in claim 1, wherein the layer including X-ray-absorbing material comprises:

at least two layers of X-ray-absorbing material, each layer of the at least two layers of X-ray-absorbing material having a different gap in an X-ray-absorbing bandwidth.

8. The device as in claim 7, wherein a first layer of X-ray-absorbing material of the at least two layers of X-ray-absorbing material comprises tungsten.

9. The device as in claim 7, wherein a second layer of X-ray-absorbing material of the at least two layers of X-ray-absorbing material comprises titanium.

10. The device as in claim 7, wherein the X-ray-absorbing material comprises material absorbing radiation having a wavelength in the range of 0.006 to 12.5 nanometers.

11. A field emission display comprising:

at least one emitter opposed to an anode having an evacuated space located therebetween;

a conductive grid layer disposed between the anode and the at least one emitter;

at least one transistor located adjacent the at least one emitter for selectively permitting the at least one emitter to emit electrons for traveling towards the anode and for selectively substantially preventing the at least one emitter from emitting electrons; a focus ring disposed between the conductive grid layer and the anode; and a radiation blocker disposed between the conductive grid layer and the anode, the radiation blocker for passing electrons emitted from the at least one emitter to the anode and for substantially shielding the at least one transistor from radiation emitted from the anode, the radiation blocker disposed on a portion of a surface of the focus ring.

12. The display as in claim 11, wherein the radiation blocker is disposed on at least one of a portion of an upper surface of the focus ring, a portion of a lower surface of the focus ring, and a portion of the upper surface and a portion of the lower surface of the focus ring.

13. The display as in claim 11, wherein the radiation blocker includes:

a first material disposed on a portion of an upper surface of the focus ring; and a second material disposed on a portion of a lower surface of the focus ring.

14. The display as in claim 13, wherein the first material differs from the second material.

15. The display as in claim 11, wherein an X-ray-blocking material is disposed on a portion of a surface of the focus ring.

16. The display as in claim 15, wherein the X-ray-blocking material is disposed on one of a portion of an upper surface of the focus ring, a portion of a lower surface of the focus ring, and portions of the upper surface and the lower surface of the focus ring.

17. The display as in claim 16, wherein the X-ray-blocking material includes:

a first material disposed on the portion of on the upper surface of the focus ring; and a second material disposed on the portion of the lower surface of the focus ring.

18. The display as in claim 17, wherein the first material differs from the second material.

19. The display as in claim 18, wherein the X-ray-blocking material includes at least one layer of material.

* * * * *